United States Patent [19]

Cramer

[11] Patent Number: 4,838,030

[45] Date of Patent: Jun. 13, 1989

[54] COMBUSTION CHAMBER LINER HAVING FAILURE ACTIVATED COOLING AND DECTECTION SYSTEM

[75] Inventor: Paul S. Cramer, Naugatuck, Conn.

[73] Assignee: Avco Corporation, Providence, R.I.

[21] Appl. No.: 82,808

[22] Filed: Aug. 6, 1987

[51] Int. Cl.[4] ..... F02C 3/00

[52] U.S. Cl. ..... 60/753; 60/39.091; 60/760

[58] Field of Search ..... 60/752, 753, 760, 39.32, 60/39.091; 416/241 B; 428/608

[56] References Cited

U.S. PATENT DOCUMENTS

| | | | |
|---|---|---|---|
| 2,548,945 | 4/1951 | Lubbock . | |
| 3,041,834 | 7/1962 | Davies et al. | 60/39.091 |
| 3,886,735 | 6/1975 | Irwin . | |
| 3,918,255 | 11/1975 | Holden . | |
| 4,004,056 | 1/1977 | Carroll | 428/138 |
| 4,064,300 | 12/1977 | Bhangu | 428/120 |
| 4,071,194 | 1/1978 | Eckert et al. | 239/127.3 |
| 4,269,032 | 5/1981 | Meginnis et al. | 60/754 |
| 4,273,824 | 6/1981 | McCorras et al. | 415/174 |
| 4,302,940 | 12/1981 | Meginnis et al. | 60/754 |
| 4,312,186 | 1/1982 | Reider | 60/754 |
| 4,315,406 | 2/1982 | Bhangu et al. | 60/754 |
| 4,629,397 | 12/1986 | Schweitzer | 416/241 B |

FOREIGN PATENT DOCUMENTS

| | | | |
|---|---|---|---|
| 2246926 | 4/1974 | Fed. Rep. of Germany | 60/223 |

*Primary Examiner*—Louis J. Casaregola
*Assistant Examiner*—Timothy S. Thorpe
*Attorney, Agent, or Firm*—Perman & Green

[57] ABSTRACT

A combustion chamber liner has three layers; a first ceramic layer, a second filamentary steel wool type layer and a third metallic layer. The interior of the liner is cooled by passages in the third layer and emergency or failure activated cooling occurs in a damaged area in the first layer. Sensor means can be placed in the liner or externally of the liner to detect changes in the coolant flow or pressure and thereby detect a failure in the liner.

15 Claims, 4 Drawing Sheets

COMBUSTION CHAMBER LINER HAVING FAILURE ACTIVATED COOLING AND DECTECTION SYSTEM

BACKGROUND OF THE INVENTION

1. Field of the Invention

This invention relates to combustion chamber liners for use in apparatus such as a gas turbine engine, and more particularly, to a combustion chamber liner having an emergency cooling and detection system activated by a failure in the combustion chamber liner.

2. Description of the Prior Art

A cross-reference is made to U.S. patent application Ser. No. 07/082,861, filed on Aug. 6, 1987, entitled "Internally Cooled Combustion Chamber Liner" by the same applicant as herein.

Combustion apparatus or combustors are used in various applications to produce heat or burn a fuel in a controlled environment. One particular use of combustors has been in the area of gas turbine engines. As employed in a gas turbine engine, a combustor ordinarily includes an exterior housing and an interior combustion chamber. Fuel is combusted in the interior of the combustion chamber producing a hot gas usually at an intensely high temperature such as 3,000° F. or even higher. To prevent this intense heat from damaging the combustor before it exits to a turbine, a heat shield or combustion chamber liner is provided in the interior of the combustion chamber. This heat shield or combustion chamber liner thus prevents the intense combustion heat from damaging the combustor or surrounding engine.

In the past, various types of combustion chamber liners have been suggested and used. In addition, a variety of different methods have been suggested how to cool these liners so as to withstand greater combustion heat or prolong the useable life expectancy of the liner. U.S. Pat. No. 2,548,485 by Lubbock and U.S. Pat. No. 3,918,255 by Holden disclose various types of combustion chamber liners. Other U.S. Patents that describe cooling of combustion chamber liners include U.S. Pat. Nos. 4,004,056 by Carroll, 4,269,032 by Meginnis et al, 4,302,940 by Meginnis, and 4,315,406 by Bhanger et al. U.S. Pat. No. 4,064,300 by Bhanger has also described a two sheet laminate being connected by heat conductive portions with a cooling fluid passing between the two sheets.

Also in the past, combustion chamber lines were made of special metal alloys. These metal alloys were manufactured to withstand the intense heat in the combustor and allow for a controlled heat transfer so as not to damage or endanger the surrounding engine. However, the cost of these types of metal alloys was unreasonably high and thus lead to the use of a metal and ceramic combination as materials for liners. The use of a metal and ceramic combination greatly reduced manufacturing cost of liners in addition to providing a more efficient heat shield.

A problem arises in using presently available combustion chamber liners that have a combination ceramic and metallic material in that ceramic material is normally brittle whereas metallic material is normally ductile, as a result, thermal gradients or differing thermal expansions between the ceramic and metallic material from the intense heat of the combustion chamber results in a substantial likelihood of a crack or break in the ceramic material. This crack or break in the ceramic material is generally known as a failure and allows heat to escape the combustion chamber resulting in further damage to the combustion chamber liner, the combustor and possibly the entire engine.

A further problem arises in using presently available combustion chamber liners having metal and ceramic layers in that in the event that a failure occurs in the ceramic material there are no means available to supply sufficient coolant to provide a directed cooling of the area about the failure to prevent further failure or damage caused by the heat in the combustion chamber.

A further problem arises in that ceramic and metallic combination combustion chamber liners do not have a suitable means to compensate for the inherently different thermal expansion properties of the materials in addition to providing a means for cooling the interior of a combustion chamber liner and providing an emergency cooling for areas where failure has occurred.

A further problem arises in that in the event that a failure does occur, the combustion chamber and combustor are ordinarily contained in an apparatus. such as a gas turbine engine, and detection of the failure will only be discovered during internal manual inspection when the combustor is not operating or by a catastrophic failure perhaps resulting in the loss of human life.

SUMMARY OF THE INVENTION

The foregoing problems are overcome and other advantages are provided by a combustion chamber liner having a means for transporting a coolant into the interior of the liner and a means for cooling the liner in an area where a failure has occurred thereby preventing further failure or damage to the liner.

In accordance with one embodiment of the invention, the liner has three layers; a first layer of refractory material, a second layer of a steel wool type entangled metallic material and a third layer of metallic material. The third layer has coolant passageways for the passage of a coolant, such as air, into the interior or second layer of the liner. The second layer is a filamentary material capable of allowing the coolant from the passageways in the third layer, to pass therethrough. The first layer covers the second layer and protects the remaining portions of the liner from the heat in the combustion chamber. In a preferred embodiment the liner is predominantly sealed with the exception of the passageways in the third layer.

During normal operation, the interior of the liner is cooled by coolant entering and exiting the liner through the passageways in the third layer. However, in the event of a failure in the first layer of ceramic material, such as a crack or break, coolant can pass through the liner and exit at the failure area into the interior of the combustion chamber. As the coolant passes through the damaged area it cools the damaged area of the liner and areas surrounding the damaged area to prevent further damage or failure.

In an alternate embodiment, the combustion chamber liner has a sensor means which senses changes in the coolant flow or cooling fluid pressure in the liner. A sensor information processor and display means can be used with the sensor means to interpret the sensor means output and detect if a failure has occurred in the liner and the amount of failure having occurred as well as displaying preprogrammed outputs. In a further alternate embodiment, the sensor means may be contained externally of the liner.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
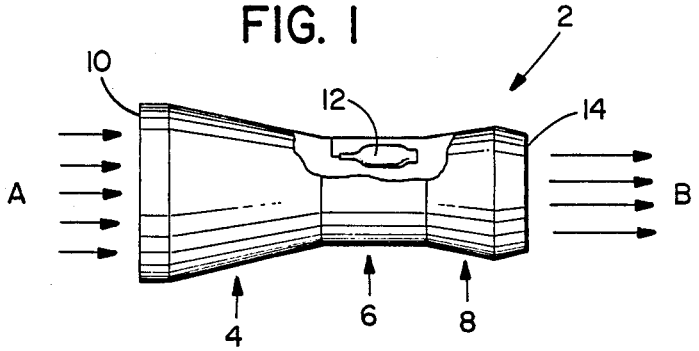
FIG. 1 is a diagrammatic view of a gas turbine engine having a combustor incorporating features of the present invention.

Referring to FIG. 1, a gas turbine engine 2 is shown. The gas turbine engine of FIG. 1 is merely shown as a representational apparatus in which a combustor is employed. It should be understood that the combustion chamber liner of the present invention is intended for use in all combustion apparatus having combustion chamber liners and is not intended to be limited to use in gas turbine engines.

The engine 2 in FIG. 1 generally has three main sections; an air compressor section 4, a combustion section 6 and a driving turbine section 8. The air compressor section 4 takes in air at the inlet 10 as shown by flow arrows A and compresses the air for introduction into the combustion section 6. The combustion section 6 has several combustors or combustion apparatus 12. Air is directed into these combustors 12 with fuel also being introduced and mixed with the air to provide an appropriate mixture for efficient combustion. Spent fuel, the hot gas product from combustion and additional cooling air are then forced into the driving turbine section 8 and exit at the exhaust 14 from the engine 2 as shown by flow arrows B.

Figure 2:
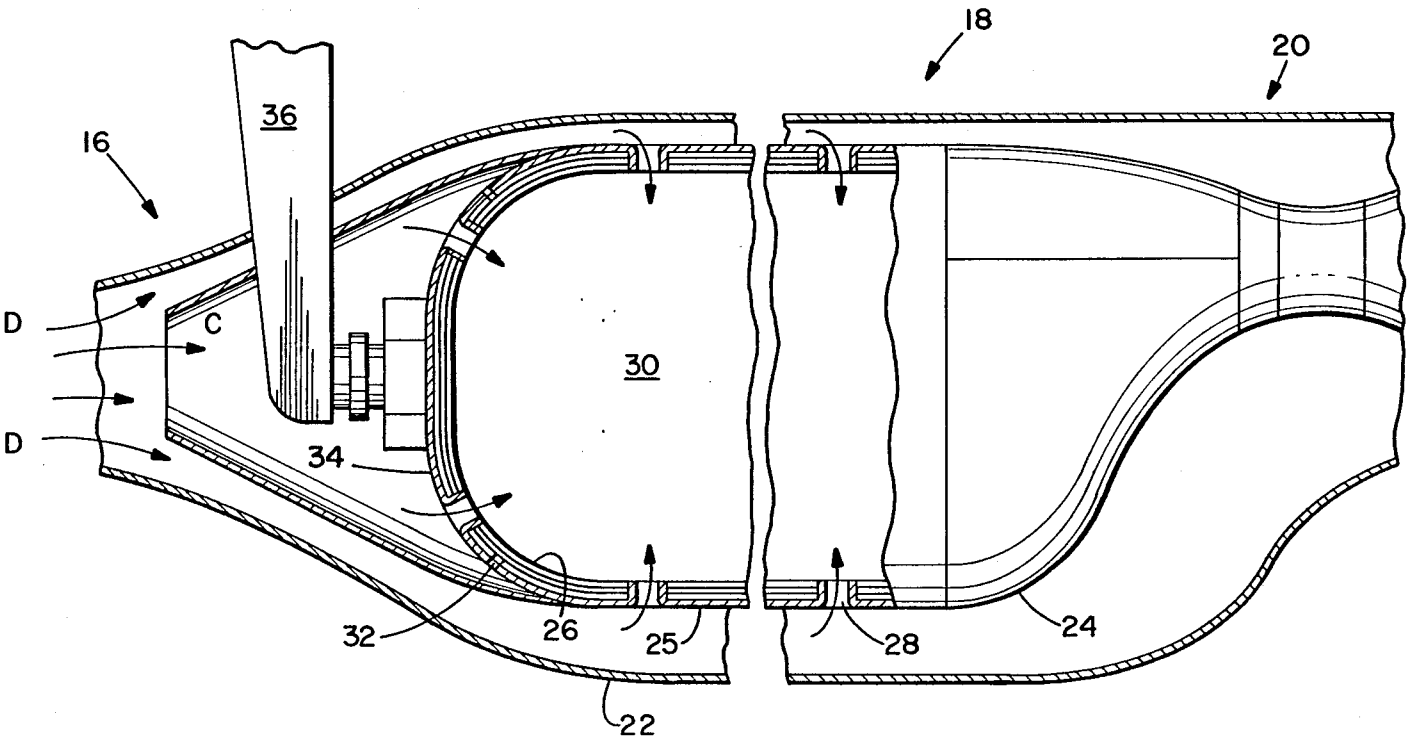
FIG. 2 is an enlarged cross-sectional view of the combustor of FIG. 1.

Referring now to FIG. 2, a more detailed description of one of the combustors 12 of FIG. 1 will be given. FIG. 2 shows an enlarged sectional view of a combustor 12 from FIG. 1. The combustor 12 is generally described as having three main sections; an air and fuel entrance section 16, a combustion chamber section 18 and an exhaust section 20. A housing 22 is generally provided for the entire combustor 12 and is ordinarily made of a metal or a metal alloy.

The combustion chamber section 18 is generally circular in cross-section with a combustion chamber 24 mounted within the housing 22. The combustion chamber 24 comprises a chamber wall 25 and a combustion chamber liner 26 forming a combustion zone 30. The chamber wall 25 is ordinarily made of a metal or a metal alloy and provides a structure for the combustion chamber liner 26 to be mounted upon. The chamber wall 25 also has two types of channels for the flow of a coolant, such as air. The first type of channels is cooling and mixing channels or ports 28 which communicate through the chamber wall 25 from the exterior of the combustion chamber 24 and through the liner 26 into the interior of the chamber and the combustion zone 30. These cooling and mixing ports 28 allow air to enter the combustion chamber 24 into the combustion zone 30 for mixing with fuel for efficient combustion. The entering air also provides cooling of the exterior portion of the liner 26 adjacent the combustion zone 30. The second type of channels, liner cooling channels 32, is generally smaller than the cooling and mixing ports 28. They are located throughout the chamber wall 25 where the liner 26 is mounted. These liner cooling channels 32 ordinarily have a specified size, shape and relation to one another and communicate from the exterior of the combustion chamber 24 to a mounting side of the liner 26. The liner cooling channels 32 provide a path for air to flow to the liner 26.

The air and fuel entrance section 16 of the combustor 12 communicates with the air compressor section 4 of the engine 2 and a fuel supply means (not shown). Compressed air is directed into the entrance section 16 and is generally separated into two paths. The first path of air, shown by flow arrow C, is directed towards a head 34 of the combustion chamber for cooling the chamber 24 and also mixing with the fuel in the combustion zone 30. The second path, shown by flow arrows D, is directed around the outside of the combustion chamber 24 between the chamber 24 and the housing 22. This second path also provides cooling to the exterior of the chamber 24 in addition to supplying cooling air for the cooling and mixing ports 28 and the liner cooling channels 32. A fuel conduit and dispensing nozzle 36 is connected to the chamber head 34 and provides fuel to the combustion chamber 24 and combustion zone 30 from the fuel supply means (not shown).

The exhaust section 20 of the combustor 12 communicates from the combustion chamber section 12 to the drive turbine section 8 of the engine 2. The exhaust section 20 performs as a type of funnel to direct the air, heat and spent fuel into the drive turbine section 8 to drive a turbine (not shown) and thereafter exit the engine.

Figure 3A:
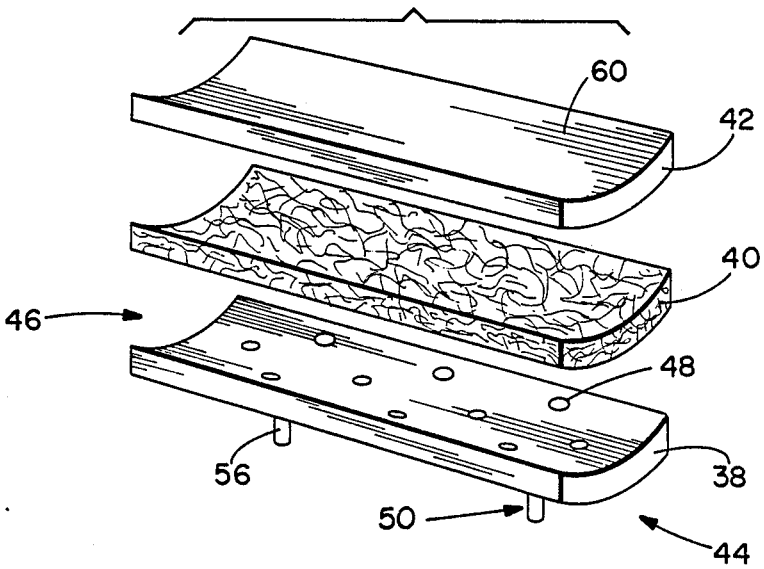
FIG. 3*a* is an exploded perspective view of a section of a combustion chamber liner incorporating features of the present invention.
Figure 3B:
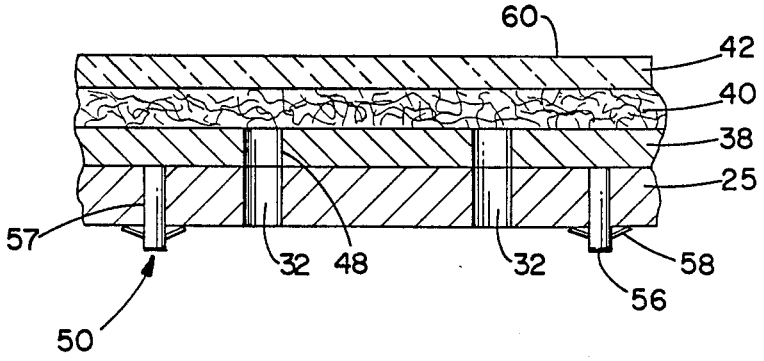
FIG. 3*b* is a cross-sectional side view of the liner in FIG. 3*a*.

Referring now to FIGS. 3*a* and 3*b*, one embodiment of a combustion chamber liner incorporating features of the invention will be described. FIG. 3*a* shows an exploded perspective view of a liner 26 manufactured as a panel and intended to be used with other liner panels to line the combustion chamber. Although the following description relates to a liner panel that is attached to the chamber wall 25, the invention is also intended to include a unitary liner placed in or fabricated on the chamber wall 25 or any other type of liner assembly. The liner 26 generally comprises three layers; a first layer 42 of impervious refractory material, a second or middle layer 40 of porous material such as steel wool type entangled metallic filaments and a third metallic layer 38. The three layers are manufactured into a single liner 26 as shown in FIG. 3*b*.

In the embodiment shown in FIG. 3*a*, the liner panel 26 is substantially rectangular with a slight curve. The curved shape is generally provided to allow the liner 26 to be cooperatingly mounted on the circular cross-sectional shape of the chamber wall 25. In addition, although the liner panel 26 is substantially rectangular in this embodiment, any type of suitable shape can be used so long as the panel can matingly cooperate with adjoining panels and mount to the chamber wall 25.

The third layer 38 is generally made of a metal or metal alloy. The third layer 38 has two opposing sides; a first or bottom side 44 and a second or top side 46. The first side 44 is for mounting the liner 26 adjacent the interior portion of the chamber wall 25. As shown in FIG. 3*b*, mounting means 50 are located on the first side 44 to fix the liner 26 to the wall 25. In the embodiment shown, the mounting means 50 is a post 56 and fasten-clip 58 type of fastener. However, any suitable type of mounting means can be used such as rivets, welding, bolts, etc. The posts 56 can extend through appropriate holes 57 in the chamber wall 25 and thereafter have the clips 58 attached thereon. The clips 58 are generally large enough to prevent the posts 56 from being withdrawn from the holes 57 in the chamber wall 25 and thus retainingly fix the liner 26 to the wall 25.

The second side 46 of the third layer 38 has the second layer 40 attached thereto. As described above, the second layer 40 is a filamentary steel wool type of metallic material. The second layer 40 may be attached to the third layer 38 by any suitable means; however, in a preferred embodiment the second layer 40 is vacuum brazened onto the third layer 38. Air channels or coolant passages 48 pass through the third layer 38 from the first side 44 to the second side 46. The passageways 48, similar to the liner cooling channels 32 in the chamber wall 25, also ordinarily have a specified size, shape and relation to one another and can generally be aligned with the liner cooling channels 32 when the liner is mounted to the interior of the chamber wall 25. When the passageways 48 are aligned with the liner cooling channels 32, coolant or cooling fluid can access the interior of the liner 26 by circulation or passage through the liner cooling channels 32 and passageways 48 into the second layer 40 of the liner 26 throughout the entire panel.

The second layer 40 of the liner 26 has been generally described as a steel wool type entangled filament metallic material. The material of the second layer 40 is generally made of a metallic material in the form of fibers or filaments that are entangled to form a mat, pad or cushion type layer. However, any type of suitable material could be used for the second layer so long as the material can withstand the heat in the liner and also act as an adjustable nexis between the first layer 42 and the remaining portions of the liner. In a preferred embodiment, the second layer 40 is made of a material known commercially as BRUNSBOND a trademark of, and manufactured by, Brunswick Technetics of Deland, Fla.

To best understand the description of the second layer 40 it is best to describe some of the properties the second layer should possess. One functional property the second layer should possess is the ability to act as a coolant reservoir for storing a substantially constant supply of relatively compressed or pressurized coolant and transporting the cooling fluid from the passageways 48 of the third layer 38 to areas adjacent the first layer 42. This function is generally accomplished by the filamentary or fibrous nature of the second layer 40 having voids among the filaments in the material. Cooling fluid can pass from the third layer 38 to the first layer 42 through the available voids in the material. In a preferred embodiment, the material of the second layer 40 allows the coolant to be located throughout the second layer 40 and substantially across the adjacent side of the first layer 42.

The material in the second layer 40 can also be fabricated in various and varying densities, in that the amount and size of the voids in the material can be preselected. By selecting a specified density, the rate of flow of a cooling fluid can, at least partially, be controlled, For example, a second layer material with a high density, having a relatively small number and size of voids, would present a difficult or restricted path for the flow of the cooling fluid and may in fact present a virtual barrier to the flow of the coolant through various preselected portions of the liner 26. On the other hand, a second layer material with a low density, having a relatively large number and size of voids, would present a relatively easy path for the coolant to flow and thereby allow a higher rate of flow through the second layer.

Figure 3C:
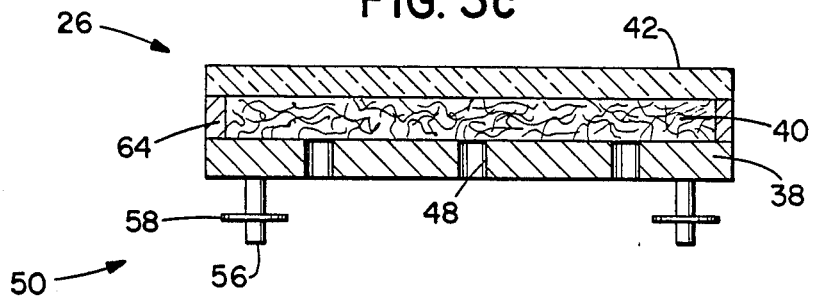
FIG. 3*c* is a cross-sectional side view of an alternate embodiment of a liner panel having ceramic material sealing the edges of the middle layer.
Figure 3D:
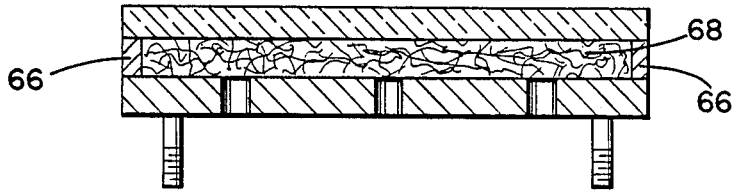
FIG. 3*d* is a cross-sectional side view of an alternate embodiment of a liner panel having a middle layer with varying density.

In various alternate embodiments, the second layer material can be fabricated in either uniform or varying densities. In a first type of embodiment as shown in FIGS. 3*a* and 3*b*, the second layer 40 can have a uniform density throughout the layer. In an alternate embodiment, the second layer 40 can be fabricated with a varying density, such as in a panel where the density of the second layer 40 could be high about the edges of the panel with a low density in the inner regions of the panel as shown in FIG. 3*d*. Such an embodiment would allow the coolant to be able to travel in the interior of the panel without easily escaping through the edges of the panel if such were not air tight.

A second functional characteristic of the filamentary material in the second layer 40 is a structural integrity sufficient to retain the third layer 38 and first layer 42 in the liner configuration. Although the second layer 40 need not be the sole means of retaining the assembly of the three layers 38, 40, and 42 together, it may at least be capable of partially performing this assembly retaining task.

A third type of functional characteristic of the entangled material in the second layer 40 is a structural adaptability or nexis to allow for different or varying thermal expansions between the first layer 42 and the third layer 38. As described above, the third layer 38 is generally made of a metallic material and the first layer 42 is generally a ceramic type of material. These two types of materials, metallic and ceramic, ordinarily have different and unequal thermal expansion coefficients or rates. In addition, metallic material is normally ductile, whereas ceramic material is normally brittle. As a result of the different properties of these materials and the high intensity of heat generated in the combustion chamber, the second layer 40 of filamentary material acts as an adjustable nexis between the first layer 42 and third layer 38 as the two layers expand and contract because of the heat. The second layer 40 thus allows both the first layer 42 and third layer 38 to expand and contract independently of one another without substantial risk that the brittle material of the first layer 42 might crack or break due to the unequal thermal expansion rates.

The first layer 42 is the inner most layer of the inner 26 and is intended to line or abut the combustion zone 30. Because of the intense heat generated in the combustion zone 30 the first layer must be a refractory material which is resistant to heat and hard to melt such as possessed by a ceramic material. In a preferred embodiment, a ceramic material such as metal oxide is used as the refractory material for the first layer 42. The first layer 42 is generally bonded or applied to the second layer 40 by means such as plasma spraying; however, any suitable bonding or application means could be used to form, bond or attach the first layer 42.

In addition to the excellent thermal properties of the first layer 42, the layer also seals the top side 60 of the liner 26. Thus any cooling fluid that enters the second layer 40 from the exterior of the chamber wall 25 is ordinarily not allowed to exit the liner 26 through the first layer 42. In a preferred embodiment, the edges of the liner 26 are sealed thus establishing only one area in which cooling fluid could enter and exit the liner under normal operating conditions; the passages 48 in the third layer 38. In one type of embodiment, as shown in FIG. 3c, the filamentary material of the second layer 40 is slightly smaller than the third layer 38 establishing a ledge type perimeter 64 about the second layer. The ceramic material of the first layer 42 is then plasma sprayed onto the second layer 40 and also extends around the edges of the second layer 40 onto the ledge type area 64 of the third layer. The first layer thus seals to the third layer 38 and thereby seals the second layer 40 with the exception of the passages through the third layer 38.

In an alternate embodiment of a partially sealed liner 26, as shown in FIG. 3*d*, the second layer has varying densities. A highly dense portion 66 of the second layer 40 is formed about the edges of the liner 26 thereby forming a barrier to the flow of coolant out the edges of the liner 26. However, the interior of the second layer 40 has a low density portion 68 whereby coolant can flow with relative ease within the interior of the liner 26. In this type of embodiment, the first layer 42 need only be applied to the top of the second layer 40 thus forming the partially sealed liner with the only exit and entry to the liner interior or second layer 40 being the passages 48 in the third layer 38.

With the liner 26 manufactured as described above the interior of the liner 26 as well as the first layer 42 and the third layer 38 can be internally cooled under normal operating conditions by the entry and exit of the cooling fluid into the liner 26 at the passages 48 in the third layer 38. However, due to the brittle nature of the material in the first layer 42 and the intense heat produced in the combustion zone 30, cracks or breaks in the first layer 42 may nonetheless occur and are commonly known as a failure of the combustion chamber liner 26.

Figure 4:
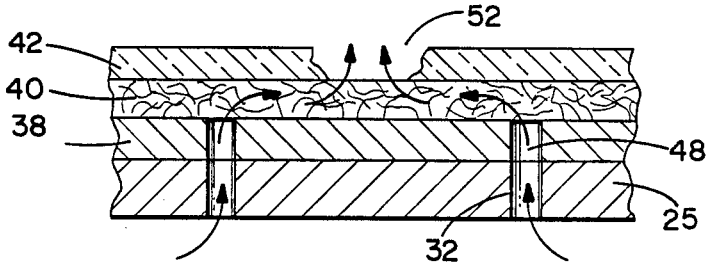
FIG. 4 is a cross-sectional view of the combustion chamber liner of FIG. 3*b* where a failure in the liner has occurred.

Referring now to FIG. 4, an emergency or failure activated cooling of the liner 26 will be described. FIG. 4 shows a cross-sectional view of the liner 26 having a failure area or damaged area 52 caused by a fracture, crack or breakage of the first layer 42 of the liner 26 causing a void to be formed through the first layer. In the embodiment shown, heat from the combustion zone 30 has a potentially damaging access point to the interior of the liner. The access point at the failure area 52 may further damage the liner 26 such as by oxidation or corrosion of the second layer 40. However, due to the structure of the liner 26 as described above, cooling fluid can travel through the liner 26 and now exit at the failure area. Due to the design of the panels, with adequate coolant inlets, ample new coolant is entered into the liner to replace the stored coolant in the coolant reservoir that is exited through the damaged area 52. The coolant can also stop the first layer around the damaged area from further breaking and thereby prevent the damaged area from increasing. The failure of the liner 26 in any location thus automatically activates the full flow of coolant through the liner 26 to the damaged area 52 and thereby activates a cooling of the damaged area to retard and prevent further damage.

As shown by the flow arrows in FIG. 4, cooling fluid or coolant passes through the liner cooling channels 32 in the wall 25 and the passages 48 in the third layer 38 into the second layer 40 and out the damaged area 52 in the first layer 42. As the coolant flows through the liner 26 it prevents further damage to both the second layer 40 and the first layer 42 from the heat in the combustion zone 30. The liner 26, in addition to internal cooling during normal operating procedures, also provides an emergency or failure activated cooling system for the combustion chamber liner.

In general operation, the liner stores a supply of coolant in the second layer 40. Upon the occurence of a failure, such as a crack or break in the first layer 42, the stored coolant is then exited from the liner through the damaged area in the first layer 42. As the coolant exits the liner it cools the damaged area. In addition, new additional coolant is introduced into the second layer 40 to replace the exited coolant.

Figure 5A:
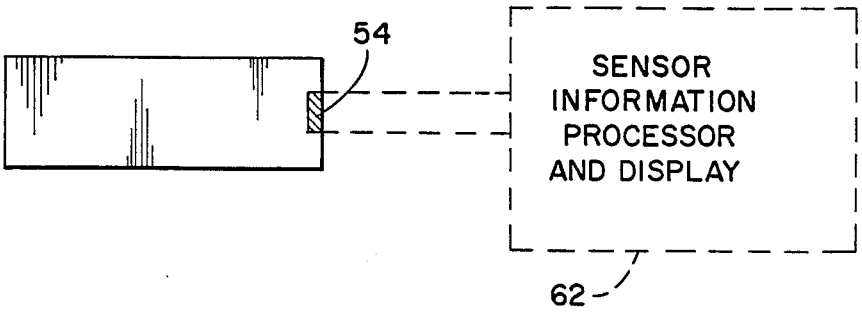
FIG. 5*a* is a diagrammatic view of a combustion chamber liner having a failure activated sensor and a sensor information processor and display.
Figure 5B:
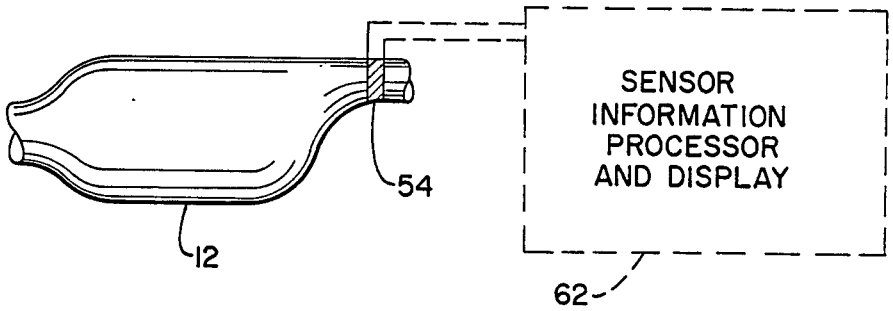
FIG. 5*b* is a diagrammatic view of a combustor having a failure activated sensor located externally of the combustor liner.

Referring now to FIGS. 5*a* and 5*b*, schematic diagrams of additional features of the invention are shown. FIG. 5*a* shows a liner 26 having a sensor 54 contained therein. The sensor 54 is generally a coolant sensor such as a pressure transducer for monitoring the flow pressure, or any other characteristic of the coolant. The sensor 54 by monitoring properties of the coolant can detect damage to a liner 26. In the embodiment shown, information from the sensor 54 is fed or inputted into a sensor information processor such as an engine monitoring computer and display means 62 such as a portable lap top computer. Information received from the sensor 54 is processed in the processor 62 in a normal data processing manner well known in the art where a comparison can be made between the information received from the sensor 54 and memory information of what the sensor should sense in a normal operating condition when the liner 26 is not damaged. The processor and display means 62 may also have appropriate means to display any sensor measurements or programmed responses to certain conditions in the liner 26. Such proposed responses are, for instance, a change in pressure. The processor 62 may, upon the sensing of a relatively large area of damage to the liner 26 by the sensor 54, indicate to the operator to stop the combustion in that combustion chamber.

FIG. 5*b* shows an alternate embodiment of the sensor 54 and the processor and display means 62 of FIG. 5*a*. In the embodiment shown, the sensor 54 is located externally of the liner 26. The sensor 54 is nonetheless placed in a suitable position to monitor a change in cooling fluid flow or pressure and thereby detect a failure in the liner 26. Similar to the embodiment shown in FIG. 5*a*, the embodiment of FIG. 5*b* also has a sensor information processor and display means 62. The processor and display means 62 can once again gather and interpret information and give a controlled or preprogrammed display or output signal.

It should be understood that the foregoing description is only illustrative of the invention. Various alternatives and modifications can be devices by those skilled in the art without departing from the scope of the invention. Accordingly, the present invention is intended to embrace all such alternatives, modifications and variances which fall within the scope of the appended claims.

What is claimed is:

1. A failure activated emergency cooled combustion chamber liner for use in a combustor having a combustion chamber wall and a combustion zone, the liner having a plurality of liner panels, each panel comprising:

first layer means of refractory material adjacent the combustion zone of the combustor, said first layer means being substantially impervious;

second layer means of porous material adjacent said first layer means, said second layer means having a coolant reservoir means for storing and transporting a supply of coolant, the coolant being relatively pressurized relative to gases in the combustion zone, said coolant reservoir means having substantial access to said first layer means adjacent said second layer means;

third layer means of metallic material adjacent said second layer means, said third layer means having coolant passage means therethrough for circulating a coolant through said third layer means into said coolant reservoir means such that a substantially constant supply of relatively pressurized coolant is maintained in said coolant reservoir means whereupon in the event of damage such as a fracture or void through the first layer means, the stored coolant in said coolant reservoir means will be directed to and through the fracture or void in said first layer means into the combustion zone thereby cooling the combustion chamber liner and preventing further damage to the liner; and means for mounting the panels to a combustion chamber wall to thereby protect the chamber wall from heat in the combustion zone.

2. A liner as in claim 1 wherein said second layer means is attached to said first and third layer means and is structurally adaptable to allow differing thermal expansions between said first layer means and said third layer means.

3. A liner as in claim 1 wherein said first layer means of refractory material is a ceramic material.

4. A liner as in claim 3 wherein said ceramic material is metal oxide.

5. A liner as in claim 1 wherein said second layer means comprises an entangled metallic filamentary material.

6. A liner as in claim 1 further comprising means for sensing the occurrence of damage to the liner.

7. A liner as in claim 6 further including means for processing signals received from said means for sensing the occurrence of damage to the liner and means for displaying processed signals.

8. A liner as in claim 1 wherein said coolant reservoir means is substantially sealed within the liner except for said coolant passage means and occurring fractures or voids in the first layer means.

9. An emergency cooling system for cooling damaged regions of a combustion chamber liner adjacent a combustion zone in a combustor comprising:

a combustion chamber liner comprising a plurality of liner panels, each panel having a first layer of refractory material adjacent the combustion zone of the combustor, said first layer being substantially impervious, a second layer of a structurally adaptable entangled filamentary material adjacent said first layer, said second layer forming a coolant reservoir therein for storing and transporting a supply of coolant, said coolant reservoir having substantial access to said first layer adjacent said second layer, and a third layer of metallic material adjacent said second layer, said third layer having first coolant passage means therethrough for circulating a coolant through said third layer into said coolant reservoir such that a substantially constant supply of coolant is maintained in said reservoir and means for mounting said third layer to a chamber wall of a combustor; and means for supplying coolant to said liner including second coolant passage means in said combustion chamber wall wherein coolant can pass through said second coolant passage means into said first coolant passage means such that in the event of a failure in said liner, such as a fracture or void through the first layer, the coolant in said coolant reservoir is directed to and through the fracture or void and into the combustion zone, said stored coolant directed through the fracture or void is replaced in said coolant reservoir by new coolant from said means for supplying coolant to said liner whereby further damage to said liner is prevented.

10. A system as in claim 9 wherein said second layer is attached to said first and third layers to allow differing thermal expansions between said first layer and said third layer with a reduced risk of causing damage to said liner.

11. A system as in claim 9 wherein said first layer is a ceramic material.

12. A system as in claim 9 wherein said liner is composed of multiple liner panels.

13. A system as in claim 9 further comprising means for monitoring the flow of coolant within said second layer whereby a change in coolant flow detects damage to said liner.

14. A system as in claim 9 wherein said coolant reservoir is substantially sealed within the liner except for said coolant passage means and occurring fractures or voids in the first layer.

15. A liner as in claim 1 wherein said panel mounting means provides means for removably mounting said liner panel to a chamber wall.

* * * * *